United States Patent [19]

Lemaire

[11] 4,418,523

[45] Dec. 6, 1983

[54] NOTCHED ROLLER FOR PRODUCING FANCY YARNS IN SPINNING-TWISTING MACHINES

[75] Inventor: Paul Lemaire, Wambrechies, France

[73] Assignee: Filature Saint Andre, Saint Andre, France

[21] Appl. No.: 291,128

[22] Filed: Aug. 7, 1981

[30] Foreign Application Priority Data

Jul. 2, 1981 [FR] France ..... 81 13017

[51] Int. Cl.[3] ..... D02G 3/36; D02G 3/34

[52] U.S. Cl. ..... 57/207; 57/18; 57/91

[58] Field of Search ..... 57/16–18, 57/90, 91, 317, 206, 207

[56] References Cited

U.S. PATENT DOCUMENTS

| | | | |
|---|---|---|---|
| 386,623 | 7/1888 | Boyd | 57/91 |
| 3,074,223 | 1/1963 | Servage | 57/91 X |
| 3,133,401 | 5/1964 | Servage | 57/91 X |
| 3,144,747 | 8/1964 | Palm et al. | 57/91 X |
| 3,394,538 | 7/1968 | Neff | 57/317 |
| 3,831,369 | 8/1974 | Northup et al. | 57/18 X |

*Primary Examiner*—John Petrakes

*Attorney, Agent, or Firm*—Toren, McGeady and Stanger

[57] ABSTRACT

A spinning-twisting machine with a hollow spindle, particularly for the production of fancy yarns, includes a drawing frame for an assembly of fibers. A drawing roller is contained in the drawing frame and it is notched at spaced locations around its circumferential surface for suppressing, locally and temporarily, the nip between a pair of drawing rollers. An assembly of fibers is passed between the drawing rollers and then through a hollow spindle where a covering yarn is wrapped around the assembly of fibers. Take-up cylinders draw the combined fancy yarn through the spindle at a peripheral speed greater than the speed of feed rollers supplying the assembly of fibers to the drawing rollers.

4 Claims, 8 Drawing Figures

NOTCHED ROLLER FOR PRODUCING FANCY YARNS IN SPINNING-TWISTING MACHINES

FIELD OF THE INVENTION

This invention relates to a spinning-twisting machine with a tubular or hollow spindle, and to the fancy yarns produced by the machine.

A machine according to the invention includes a drawing system for an assembly of fibers including a pair of drawing rollers. One of the drawing rollers preferably the upper cylinder, or pressure cylinder, generally made of, or covered with, natural or synthetic rubber, or another elastomer, is provided with angularly spaced notches or recesses in its circumferential surface.

In the present specification, the term "pressure roller" is used to designate a single pressure cylinder as well as each of the cylindrical rollers connected by an axis and forming what is usually called the "drawing cylinder".

DESCRIPTION OF THE PRIOR ART

An apparatus is known for producing flaked yarns including a drafting zone comprising two pairs of drafting rollers, one pair of drafting rollers including a rubber or rubber-faced pressure roller provided with a number of circularly extending depressions, and a fluted roller made of metal cooperating with the rubber or rubber-faced pressing roller.

This device is strictly limited to the production of flaked yarns on drafting and spinning frames provided with usual spindles.

An object of the invention is to provide for the production of fancy yarns of a very great diversity on spinning-twisting machines with hollow or tubular spindles.

BRIEF STATEMENT OF THE INVENTION

The invention includes the use of a notched roller for a spinning-twisting machine with a hollow spindle with the characteristic feature of which is that the continuity of its circumferential peripheral surface is interrupted by notches, or recesses, extending over a more or less substantial arc of its periphery, and the effect of which is to suppress, locally and temporarily, the nip between the two rollers of the pair of drawing cylinders of the drawing system.

According to a modified embodiment this notched roller has at least two differently formed circumferentially and axially extending slices or sections.

The invention further relates to a spinning-twisting machine with hollow spindles, particularly for the production of fancy yarns, comprising in combination a drawing system for an assembly of fibers including a notched drawing roller and delivering an effect yarn which is introduced with a binding or covering yarn into a hollow spindle, with the product of the two components being subjected, at the outlet of the hollow spindle, to the action of take-up cylinders.

BRIEF DESCRIPTION OF THE DRAWINGS

The invention will be better understood from the following description which relates to various embodiments of a notched roller and to a spinning-twisting machine with hollow spindles for producing fancy yarns, comprising the use of such rollers, with reference to the accompanying, wherein.

Figure 1:
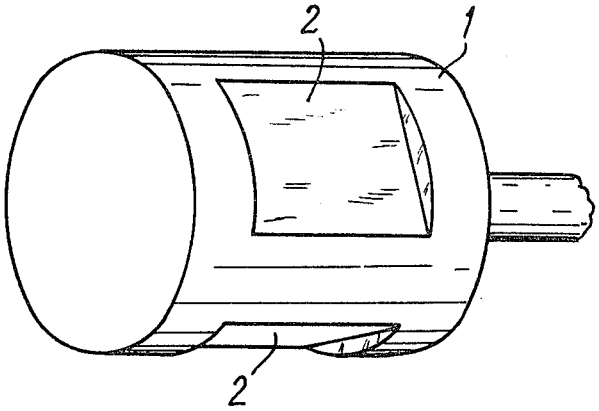
FIG. 1 is a perspective view of a notched roller according to the invention.

As regards FIG. 1, the roller 1, for example made of rubber, is formed with notches 2 in its circumferential periphery, three in number in the example shown.

Figure 2:
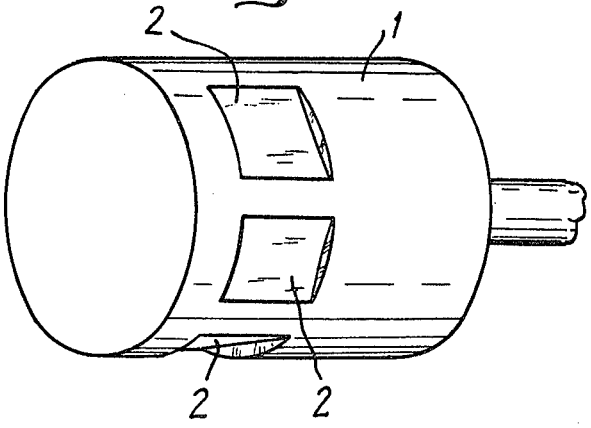
FIG. 2 shows in perspective an alternative embodiment of such a roller.

FIG. 2 shows an alternative embodiment where a greater number of notches 2 are used, six for example, and the arc over which each notch extends is less than in the case of FIG. 1.

Figure 3:
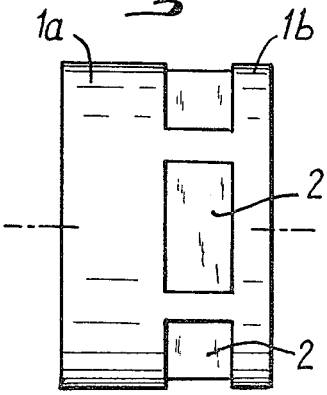
FIGS. 3 and 4 show an embodiment of a roller having differently arranged slices or sections.
Figure 4:
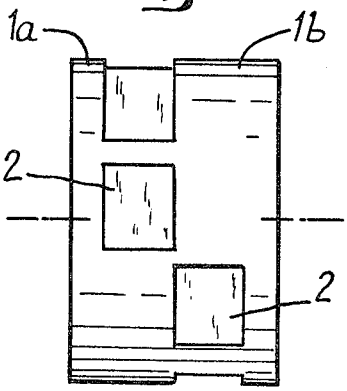

Each of FIGS. 3 and 4 shows a roller with differently arranged circumferential and axially extending slices or sections 1*a* and 1*b*.

In FIG. 3 the notches 2 are formed only in the section 1*b* while in FIG. 4 notches 2 are formed in each of the sections 1*a* and 1*b*, with the notches in section 1*a* offset from the notches in section 1*b*.

Figure 5:
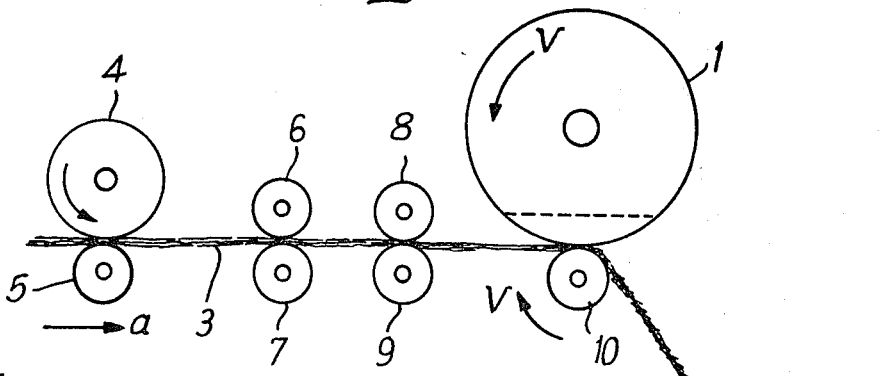
FIG. 5 shows a spinning-twisting device with a hollow spindle.

In the device of FIG. 5, notched rollers are used in the spinning-twisting device including a hollow spindle. An assembly of fibers, roving or silver 3, subjected to the lamination, are utilized to form the effect yarn of the fancy yarn, which passes, in turn, through feed rollers 4,5; intermediate rollers, 6, 7 and 8, 9 and drawing cylinders 1, 10. From the drawing cylinders the fibers 3 pass into a tubular or hollow spindle 11 on which a package 12 of a binding or covering yarn 13 is mounted. The covering yarn 13 is introduced into the hollow spindle 11 at the same time as the fibers 3 arriving from the drawing or delivering rollers 1, 10. The upper roller 1 is a notched roller. The yarn 14 exits from the outlet of the spindle 11 and is taken up by a pair of cylinders 15, 15, the take-up speed of the yarn product is rigorously fixed, variable or not, by the speed of the taking-up cylinders 15, 15.

Figure 6:
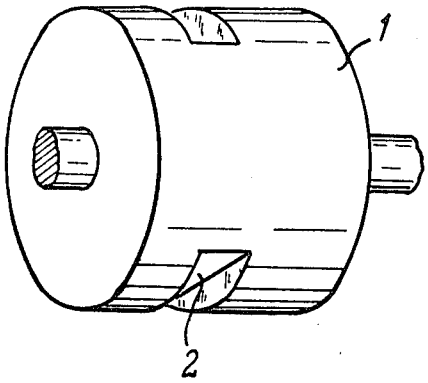
FIG. 6 shows the notched pressure roller as used in the arrangement in FIG. 5.

The upper roller 1 of FIG. 5 is shown in FIG. 6 containing a pair of diametrically opposite notches 2.

Figure 7:
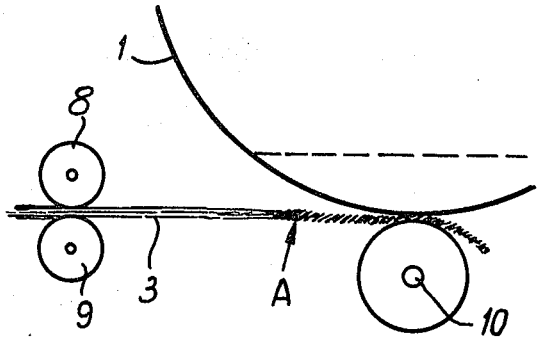
FIG. 7 is a detailed view illustrating more specially the situation at the moment where the yarn in formation leaves a recess and is engaged again with a smooth portion of the roller.

In FIG. 7 the assembly of fibers, roving or sliver 3 is shown passing from the intermediate rollers 8, 9 to the drawing or delivery rollers 1, 10. The yarn A shows the manner of formation as it leaves a recess and is engaged again with a smooth portion of the drawing roller.

The operation is as follows:

The notches, or recesses 2 in drawing cylinder 1 stop the normal drawing and allow the yarn in formation which is called at the speed v, (FIG. 5) to apply a traction on the fibers which are under the notch over a certain distance upstream and downstream of the drawing rollers, the fibers being fed by the pair of feeding rollers 4, 5 at a speed a which is much smaller than v.

Figure 8:
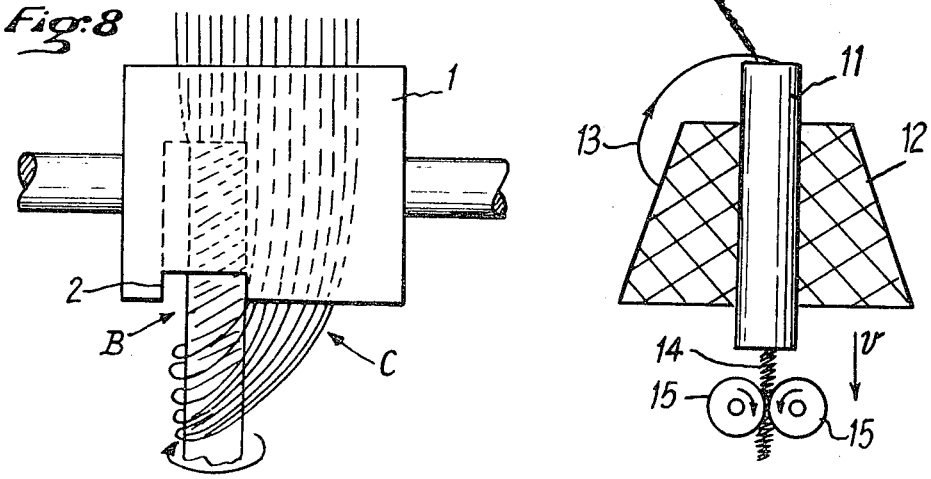
FIG. 8 shows the behaviour of the fibers when passing under a notch.

The result is that the yarn in formation, at the moment where it passes into a notch, is decomposed (FIG. 8) into two elements, or two kinds of elements, viz. one or several stretched elements, subjected to a false twist moving back upstream of the drawing rollers and forming the element B and elements C which come out of the drawing rollers, on the side of the notches, at speed V. The elements C are wound, due to the rotation of elements B, in a spiral about the latter, which thereby play the part of filler yarn.

It can be easily appreciated that if, on the same roller, notches are associated with smooth portions, the result is as if there was, on the same machine, a drawing roller running at speed V and another at speed v.

Hence the following applications:

(1) The same drawing roller can be divided into several circumferentially and axially extending slices or sections, for example two sections, fictitiously separated by a plane perpendicular to the cylinder axis, one of which 1*b* is notched and the other 1*a* is smooth (FIG. 3). The component which comes out at speed v from the first section plays the part of a core yarn and wraps about itself the second component which is emerging from the smooth section at speed V and produces, after having passed through the hollow spindle, a single yarn.

(2) The component which is supplied by the smooth section, instead of coming from the same roller as in the preceding paragraph, can come from a smooth cylinder of a neighbouring drawing system.

(3) The yarn produced according to paragraph (1) and which is called up at speed v can also be used as a core yarn relative to a component supplied at speed V.

In the composite drawing arrangement of FIG. 4, the two sections 1*a* and 1*b* are regularly notched, but only over 180$^{5}$, or twice 90°, and located opposite the corresponding smooth portion.

It is obvious that the invention is not limited to particular embodiments and that modifications and improvements of details can be envisaged without departing from its scope.

On the other hand, one should observe that the notching system provided on the upper drawing cylinder made of rubber, or elastomer, can also be considered as being applied to the lower drawing roller which is generally metallic.

I claim:

1. A spinning-twisting machine for producing fancy yarns from a non-twisted sliver of textile fibers, said machine having an inlet end at which the sliver of textile fibers is introduced into the machine and an outlet end from which the fancy yarn is removed from the machine, said machine comprising a pair of feed cylinders located at the inlet end for feeding the sliver through the machine, a pair of drawing cylinders spaced from said pair of feed cylinders, said pair of drawing cylinders comprising a first cylinder having a continuous smooth cylindrical circumferentially extending surface for its full axial length and a second cylinder comprising two sections in axial alignment one following the other with at least one of said sections having at least one circumferentially extending notch formed in the circumferential peripheral surface thereof, said notch extending in the circumferential and axial direction of said second cylinder, said drawing cylinders arranged to be driven at a peripheral speed greater than the peripheral speed of said feed cylinders, said drawing cylinders arranged for forming a nip therebetween with the sliver passing through the nip of said drawing cylinders for the full axial length of the nip which includes the full axial length of said two sections of said second cylinder, a rotatable tubular spindle located between said nip of said drawing cylinders and said outlet end and arranged so that the sliver exiting from the nip of said drawing rollers passes through said tubular spindle, a package of a covering textile thread mounted on said tubular spindle for rotation therewith and said covering thread entering said tubular spindle with the sliver, a pair of take-up cylinders located at said outlet end of said machine for pulling the fancy yarn through said spindle, said take-up cylinders having a peripheral speed greater than the peripheral speed of said feed cylinders, so that the portion of the sliver passing through the notch in said second drawing cylinder is subjected to a false twist by the rotating action of said tubular spindle and is stretched by the action of said take-up cylinders while the remaining portion of the sliver passing through the nip of said drawing cylinders outside of said notch is pulled at a speed greater than the linear speed of the portion of the sliver passing through said notch and is wound around the portion of the sliver passing through said notch whereby all of the fibers of the sliver enter said rotary tubular spindle together along with the covering thread to form the fancy yarn withdrawn from the tubular spindle by said take-up cylinders.

2. A spinning-twisting machine for producing fancy yarns from a non-twisted sliver of textile fibers, said machine having an inlet end for receiving the sliver of textile fibers and an outlet end for discharging the fancy yarn formed from the sliver of textile fibers, said machine comprising a pair of feed cylinders located at said inlet end for feeding the sliver into the machine, a pair of drawing cylinders spaced from said feed cylinders and arranged to receive the sliver from the feed cylinders, said drawing cylinders comprising a first drawing cylinder having a smooth cylindrically shaped circumferentially extending surface for its full axial length and a second drawing cylinder comprising a pair of circumferentially and axially extending sections one aligned with the other in the axial direction thereof, said two sections comprising a first section having a continuous smooth circumferential surface for the axial length thereof with said smooth circumferential surface disposed in engagement with the circumferential surface of said first drawing cylinder and a second section having the same outside diameter as said first section with at least one notch formed in the circumferential surface thereof and extending in the circumferential direction with said notch extending for only a portion of the circumferential dimension of said section, said first and second drawing cylinders being arranged to rotate at a peripheral speed greater than the peripheral speed of said feed cylinders, said first and second drawing cylinders forming a nip therebetween extending for the full axial length of said cylinders, the sliver extending from said free cylinders passes through the nip of said first and second drawing cylinders over the full axial length of the nip with a first portion of the sliver disposed in engagement with the first section of said second drawing cylinder and a second portion of the sliver disposed in engagement with the circumferential surface of the second section of said second drawing cylinder, a rotatable tubular spindle spaced between said drawing cylinders and said outlet for receiving the sliver exiting from the nip formed by said first and second drawing cylinders, a package of a covering textile thread mounted on the exterior of said tubular spindle and arranged to rotate therewith so that the covering thread can enter said tubular spindle along with the sliver passing from the first and second drawing cylinders, a pair of take-up cylinders located at said outlet end for withdrawing the fancy yarn passing through said tubular spindle and the peripheral speed of said take-up cylinders arranged to be greater than the peripheral speed of said feed cylinders, so that the portion of the sliver passing through the notch in the second section of said second drawing cylinder is subjected to a false twist by the rotating action of said tubular spindle and is stretched by the action of said take-up cylinders and the remainder of the sliver passing through the nip formed by the smooth surfaces of said first and second cylinders travels at a speed greater than the linear speed of the portion passing through said notch so that it is wound around the portion passing through said notch with the fibers of the sliver passing through said tubular spindle being wrapped by the covering thread to form the fancy yarn withdrawn by said take-up cylinders.

3. A spinning-twisting machine, as set forth in claim 1, wherein both sections of said second drawing cylinder are notched and the notched portion of one said section is spaced angularly from the notched portion of the other said section so that in the axial direction of said drawing cylinder the notched portions of said first and second sections are aligned in the axial direction opposite a smooth section of the adjacent said section.

4. A fancy yarn formed by feeding a non-twisted sliver of textile fibers through a nip between a pair of feed cylinders, rotating the feed cylinders at a first peripheral speed, feeding the sliver from the feed cylinders to a pair of drawing cylinders, forming a nip therebetween so that the sliver passes through the nip, rotating the drawing cylinders at a second peripheral speed greater than the first peripheral speed of the feed cylinders, providing circumferentially extending notches in at least a portion of the circumferentially extending surfaces of one of the drawing cylinders, introducing the sliver to the nip between the drawing cylinders so that the sliver extends over the full axial length of the nip, and passing the sliver through the nip so that a portion of the sliver is located within the notch extending radially from the nip whereby the portion of the sliver out of contact with the notch as it passes through the nip moves at a greater speed than the portion of the sliver in contact with the notch in the nip, feeding the sliver from the drawing cylinders to a rotating tubular passage and rotating the tubular passage about its axis, mounting a package of a covering thread on the tubular passage so that it rotates with the tubular passage, feeding the covering thread into the tubular passage along with the sliver so that the covering thread wraps around the sliver, and withdrawing the combined sliver and covering thread from the tubular passage by a pair of take-up cylinders and rotating the take-up cylinders at a peripheral speed greater than the first speed of the feed cylinders.

* * * * *